US010777053B2

(12) United States Patent
Jenkins et al.

(10) Patent No.: US 10,777,053 B2
(45) **Date of Patent: *Sep. 15, 2020**

(54) WEARABLE CHARM ANTI-THEFT SYSTEM WITH A SNOOZE FEATURE

(71) Applicant: Charm Alarm LLC, Beverly Hills, CA (US)

(72) Inventors: Diane Jenkins, Beverly Hills, CA (US); Harry Tarnoff, Los Angeles, CA (US); Warren Juran, Los Angeles, CA (US)

(73) Assignee: Charm Alarm LLC, Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/458,124

(22) Filed: Jun. 30, 2019

(65) Prior Publication Data

US 2020/0058204 A1 Feb. 20, 2020

Related U.S. Application Data

(63) Continuation of application No. 16/055,818, filed on Aug. 6, 2018, now Pat. No. 10,339,774, which is a continuation of application No. 15/697,391, filed on Sep. 6, 2017, now Pat. No. 10,062,252, which is a continuation of application No. 15/228,921, filed on Aug. 4, 2016, now Pat. No. 9,786,142, which is a continuation of application No. 14/849,403, filed on Sep. 9, 2015, now Pat. No. 9,437,091, which is a continuation of application No. 14/001,800, filed as application No. PCT/US2013/034192 on Mar. 27, 2013, now Pat. No. 9,165,447.

(60) Provisional application No. 61/617,043, filed on Mar. 28, 2012.

(51) Int. Cl.

| | |
|---|---|
| ***G08B 13/14*** | (2006.01) |
| ***G08B 21/02*** | (2006.01) |
| ***G08B 13/24*** | (2006.01) |

(52) U.S. Cl.

CPC ..... *G08B 13/1472* (2013.01); *G08B 13/1427* (2013.01); *G08B 13/2402* (2013.01); *G08B 13/2462* (2013.01); *G08B 21/0216* (2013.01); *G08B 21/0225* (2013.01); *G08B 21/0233* (2013.01); *G08B 21/0277* (2013.01); *G08B 13/1436* (2013.01); *G08B 21/0247* (2013.01)

(58) Field of Classification Search

CPC ..... G08B 13/1472; G08B 21/0233; G08B 13/2402; G08B 21/0277; G08B 21/0225; G08B 21/0216; G08B 13/2462; G08B 13/1427; G08B 13/1436; G08B 21/0247

USPC .... 340/572.1, 539.21, 539.15, 686.1, 539.23

See application file for complete search history.

(56) References Cited

U.S. PATENT DOCUMENTS

| | | | |
|---|---|---|---|
| 5,396,218 | A | 3/1995 | Olah |
| 5,963,131 | A | 10/1999 | Bresler et al. |
| 6,133,830 | A | 10/2000 | D'Angelo |

(Continued)

FOREIGN PATENT DOCUMENTS

| | | |
|---|---|---|
| WO | WO2009124108 | 10/2009 |

*Primary Examiner* — Anh V La

(74) *Attorney, Agent, or Firm* — David M. Kleiman

(57) ABSTRACT

An anti-theft proximity alert system that includes a wearable smart charm with a charm housing, and an object monitor with a housing and a snooze switch, and a controller with at least one snooze operating instruction to adjust a threshold alert criterion based upon a setting of the snooze switch.

2 Claims, 5 Drawing Sheets

(56) References Cited

U.S. PATENT DOCUMENTS

| | | | | |
|---|---|---|---|---|
| 6,847,295 | B1 | 1/2005 | Taliaferro et al. | |
| 8,487,758 | B2 | 7/2013 | Istoc | |
| 9,165,447 | B2 | 10/2015 | Jenkins et al. | |
| 9,437,091 | B2 | 9/2016 | Jenkins et al. | |
| 9,786,142 | B2 | 10/2017 | Jenkins et al. | |
| 10,062,252 | B2 | 8/2018 | Jenkins et al. | |
| 10,339,774 | B2 | 7/2019 | Jenkins et al. | |
| 2006/0023626 | A1* | 2/2006 | Krausz | G08B 13/1427 370/220 |
| 2006/0077041 | A1 | 4/2006 | Chan et al. | |
| 2008/0055072 | A1 | 3/2008 | Holoyda | |
| 2009/0181726 | A1 | 7/2009 | Vargas et al. | |
| 2010/0097237 | A1 | 4/2010 | Christiansen | |
| 2010/0317302 | A1* | 12/2010 | Greenwood | H01Q 1/2258 455/127.1 |
| 2010/0321899 | A1* | 12/2010 | Vossoughi | B60R 11/02 361/728 |
| 2011/0285506 | A1* | 11/2011 | Hillis | G08B 21/0238 340/8.1 |
| 2012/0235826 | A1 | 9/2012 | Perry | |
| 2014/0171132 | A1 | 6/2014 | Ziemianska et al. | |
| 2014/0171146 | A1 | 6/2014 | Ma et al. | |
| 2014/0172873 | A1 | 6/2014 | Varoglu et al. | |

* cited by examiner

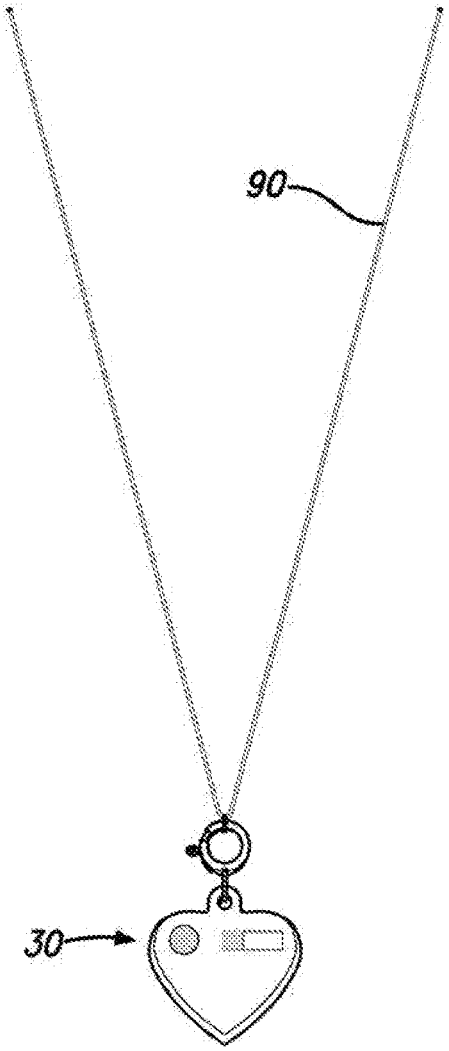
FIG. 3
FIG. 4
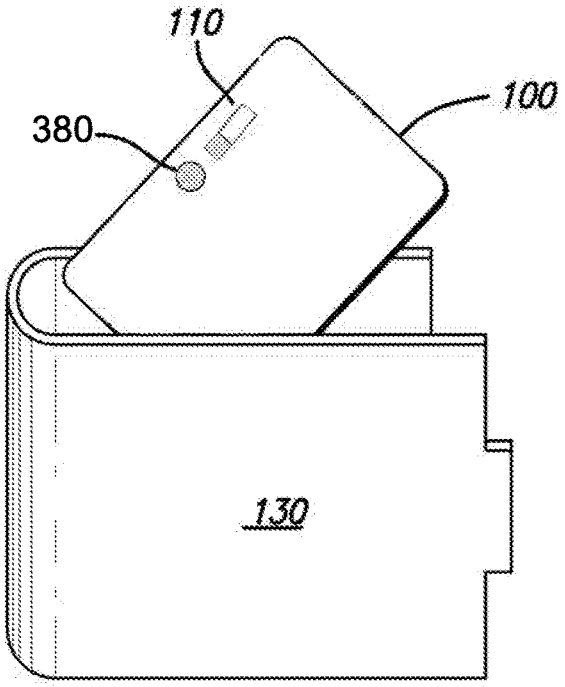

WEARABLE CHARM ANTI-THEFT SYSTEM WITH A SNOOZE FEATURE

This application claims the benefit of priority to, and is a continuation of U.S. patent application Ser. No. 16/055,818 that was filed on Aug. 6, 2018, which is a continuation of U.S. patent application Ser. No. 15/697,391 that was filed on Sep. 6, 2017 now issued as U.S. Pat. No. 10,062,252, which is a continuation of U.S. patent application Ser. No. 15/228,921 that was filed on Aug. 4, 2016 now issued as U.S. Pat. No. 9,786,142, which is a continuation of Ser. No. 14/849,403 that was filed on Sep. 9, 2015 now issued as U.S. Pat. No. 9,437,091, which is a continuation of U.S. patent application Ser. No. 14/001,800 that was filed on Aug. 27, 2013 now issued as U.S. Pat. No. 9,165,447 and which was a national stage entry of International PCT application PCT/US13/34192 filed on Mar. 27, 2013. The full contents of each of the aforementioned applications and patents are hereby incorporated by reference. This application also claims the benefit of priority of U.S. provisional patent application 61/617,043 filed on Mar. 28, 2012 the full contents of which are hereby incorporated by reference.

TECHNICAL FIELD

This invention relates to an object proximity system, and more particularly, to system which includes a smart alarm and an object monitor, where the smart alarm and object monitor communicate relative proximity information and alert the user when a pre-set separation distance is exceeded. The smart alarm may be in the form of an ornamental jewelry charm (i.e. a "smart charm") that is wearable by a user.

BACKGROUND ART

A variety of anti-theft systems are employed by people for various practices. One of the most common stolen items is someone's purse or wallet. Many anti-theft devices have been created to help combat this issue but few have seamlessly integrated fashion with utility to effectively counter theft.

Methods of theft prevention vary from physical cords to electronic transmitters. While these devices may lower the incidence of theft, users can perceive them as bulky and unattractive, which decrease the users' desire to implement them into everyday use.

While various means of anti-theft transmitter and receiver units exist in the prior art, they are limited in that they are cumbersome and unattractive to the user and are not easily implemented into a user's wardrobe and style. Therefore, a need exists for a non-cumbersome and fashionable anti-theft system which allows a user to protect his or her belongings. The present invention satisfies these needs.

DISCLOSURE OF THE INVENTION

The system of the present invention will help prevent theft of personal property while being unobtrusive to the eye and seamlessly integrating into current day fashion. The system has a first component that is an attractive and light-weight smart charm that is attachable to a wearable accessory such as a bracelet or necklace, item of clothing, or user. The system also has a second component that is an object monitor for attaching or combining with a mobile object, such as a wallet or purse. The smart charm and object monitor communicate proximity information between each other, and set off a perceptible alarm through one or more sensory alert mechanisms when the separation distance between the smart charm and object monitor exceeds a threshold alert criterion.

In a preferred embodiment the smart charm system component has a housing in the form of a small charm (e.g. a pendant or trinket) that is easily attached to wearable accessories such as a charm bracelet, and is contemplated to be largely indistinguishable to observers from other ordinary charms that may be on the bracelet. The preferred embodiment of the smart charm component is contemplated to generally not exceed 17 mm in diameter and be roughly the size of a grape.

For example the smart charm housing may be in a form like that of popular charms produced by Brighton® or Pandora Jewelry. Although these brands are used here as an example, the forms of other known brands may also be used. The smart charm will appeal aesthetically to the user while helping to protect the user's belongings from theft. The smart charm is intended to be more appealing than a conventional key ring alarm system. Like conventional charms, the smart charm is contemplated to have an accessory attachment means attached to or incorporated into the smart charm housing to facilitate the ready attachment and removal of the smart charm to an accessory item such as a bracelet.

The smart charm housing contains a power source that is preferably a replaceable or rechargeable battery which under conditions of ordinary and reasonable usage powers the charm for at least one year before requiring replacement or recharge. When the smart charm's battery is low, the user may be notified by a sensory alert mechanism such as a low volume beeping sound.

The smart charm housing will have an accessible switch mechanism to allow a user to turn the smart charm on and off (and possibly remotely activate/deactivate the object monitor component as well). The smart charm may also, or in the alternative, have an automatic sensor to activate/deactivate the system based on environmental conditions such as ambient light or noise levels, or the passage of time.

The object monitor system component may have a housing that is the same width and height as a standard banking card (in accordance with the dimensions set forth in ISO/IEC 7810 ID 1 card standard), and as such will fit into a standard credit card slot of a user's wallet or purse. Such an object monitor housing may have rounded corners. The thickness of such an object monitor housing may vary from that of a standard banking card so as to accommodate the working electronic components contained within it.

The object monitor housing contains a power source that is preferably a replaceable or rechargeable battery which under conditions of ordinary and reasonable usage powers the object monitor for at least one year before requiring replacement or recharge. When the object monitor's battery is low, the user may be notified by a sensory alert mechanism such as a low volume beeping sound.

The system has one or more sensory alert mechanisms incorporated into the smart charm and/or object monitor that are used to notify a user when a component goes into an active state (i.e. the power turns on) and/or the separation distance between an active smart charm and active object monitor exceeds a threshold alert criterion. The sensory alert mechanisms are contemplated to include (1) an auditory signal generator capable of making a loud sound (e.g. 75+dB) such as a piezoelectric speaker, (2) a light source such as light emitting diodes, and/or (3) a mechanical vibration generator such as a coin vibration motor.

In operation proximity signals are communicated between the smart charm component and object monitor. The smart charm and object monitor each have a communicator that in the preferred embodiment is a low power radio frequency transceiver operating in the Industrial Scientific and Medical ("ISM") radio frequency band of 2.4 GHz. Each smart charm and object monitor has a paired communication link where in the preferred embodiment the smart charm acts primarily as a receiver for radio frequency proximity signals transmitted by the object monitor component.

The smart charm has flash memory containing operating instructions for implementation by a controller in the smart charm. These operating instructions include instructions for measurement of received proximity signals transmitted by the paired object monitor. The smart charm operating instructions also contain instructions for the smart charm controller to determine the separation distance between the smart charm and object monitor based on the measurement of the received proximity signal. If the separation distance is greater than an alarm threshold alert criterion set by the system, then the smart charm controller shall initiate an alert sequence in accordance with the smart charm operating instructions. In a preferred embodiment, the alarm threshold alert criterion would be in the range of ten to fifteen feet for a separation distance between the smart charm and object monitor.

An initiated alarm sequence may commence with a brief warning signal from a sensory alert mechanism, such as a vibration on the smart charm, to alert the user that an alarm is about to be triggered. The warning signal may in a preferred embodiment have duration of one-quarter to six seconds. The warning signal can give a user an opportunity to cancel an alarm by, for example, manually pushing a silence or snooze button. Alternatively, the alarm sequence may remain at the warning signal stage until it is determined that the separation distance between the smart charm and the object monitor exceeds a second full alarm threshold alert criterion. For example, once the separation distance is determined to be ten feet, a warning signal may be activated, followed by a full alarm if the separation distance increases beyond fifteen feet.

After the warning period the smart charm activates or intensifies the sensory alert mechanisms on the smart charm to a full alarm state, and concurrently transmits an alarm signal to be received by the paired object monitor. When the alarm signal is received by the paired object monitor, a sensory alert mechanism is activated on the object monitor, such as, for example, a piezoelectric speaker that may produce a loud (e.g. 90+dB) alert. The sensory alert mechanism on the object monitor shall continue until a stop signal transmitted from the smart charm is received by the object monitor, or the sensory alert mechanism is manually cancelled by a switch mechanism on the object monitor (e.g. turning it off), or possibly a pre-determined period of time passes. The number and intensity of sensory alert mechanisms may also be varied depending upon the separation distance between the smart charm and object monitor. Thus, for example, an alert on the smart charm may become louder as the object monitor moves further way.

To help prevent false alarms a motion detector may be incorporated into the object monitor. The motion detector generates a signal to indicate the motion state of the object monitor. When the object monitor is at rest it will transmit proximity signals at maximum power. By doing so there is a reduced probability that environmental factors (e.g. an intervening object or passerby) will prevent the receipt and measurement of the proximity signal by the smart charm which could trigger a false alarm. However, if the object monitor is in motion, which could be an indication of theft, the object monitor shall reduce the transmission power of the proximity signals. This effectively reduces the distance at which proximity signals will be detected and measured by the smart charm, increases the chances of environment interference, and overall makes it more likely that an alarm will be triggered unless the object monitor and smart charm are in close proximity such as when a moving user has the object monitor on their person.

While the embodiment of the system described above and herein is implemented with the smart charm component acting primarily as the receiver of proximity signals transmitted by the object monitor component, the system of the present invention could just as well be implemented with the object monitoring component acting primarily as the receiver of proximity signals transmitted by the smart charm component. Likewise the smart charm and object monitor may in some systems transmit and receive equally, essentially performing mirror functions to increase accuracy and possibly range.

These and other objectives of the present invention will become obvious to those of ordinary skill in the art after reading the following detailed description of the preferred embodiments. It is to be understood that the foregoing general description and the following detailed description are exemplary, and are not intended to be limiting but to provide further explanation of the invention as claimed.

BRIEF DESCRIPTION OF THE DRAWINGS

FIG. 3 is a rear perspective view a smart charm on a necklace chain.

FIG. 4 is a front perspective view of an object monitor and wallet.

BEST MODE FOR CARRYING OUT THE INVENTION

Embodiments of the present invention are described herein. Those of ordinary skill in the art will realize that the following detailed description of the present invention is illustrative only and is not intended to be in any way limiting. Other embodiments of the present invention will readily suggest themselves to such skilled persons having the benefit of this disclosure.

The preferred embodiment of the present invention comprises a smart charm adapted to fit on a standard sized charm bracelet, and an object monitor of a size and shape to fit into a standard sized card slot in a wallet or purse (i.e. a "smart card"). As described in greater detail herein, in the preferred embodiment the smart charm receives a radio frequency proximity signal from the object monitor which it measures and processes to determine whether a threshold alert criterion, which is indicative of the separation distance between the smart charm and the object monitor, has been satisfied. If the threshold alert criterion is not satisfied then this may be an indication of theft of the object containing the object monitor, and an alert sequence triggering a sensory alert to notify the user will be commenced.

The Smart Charm

Figure 1:
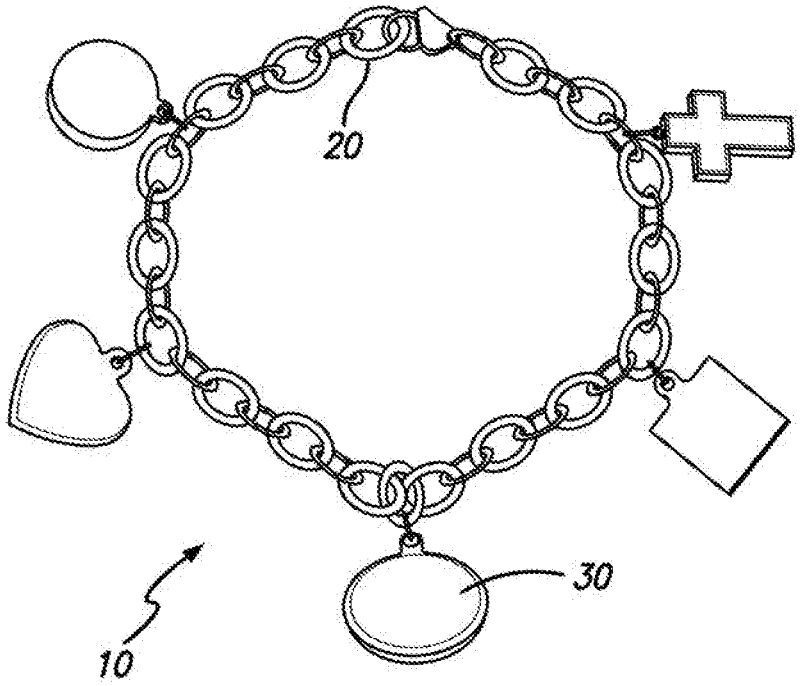
FIG. 1 is a top perspective view of a charm bracelet with a smart charm.

Referring to FIG. 1, in a preferred embodiment of the present invention there is a wearable accessory, such as for example a charm bracelet 10, having a chain 20 and at least one smart charm 30. The chain 20 may be of any material, including, for example, metal, plastic, fabric etc. . . . As used in the system of the present invention smart charm 30 is contemplated to be of a size, shape and outward appearance comparable to conventional pendants, trinkets, or other objects customarily attached to bracelets, necklaces, pins, or other user wearable accessories.

In the example shown in FIG. 1 the wearable accessory charm bracelet 10 is intended to be worn on the wrist of a user of the system in the conventional manner that charm bracelets are worn. In such a case charm bracelet 10 may have multiple charms on chain 20, at least one of which shall be a smart charm 30 in accordance with the system of the present invention (e.g. electronic and in communication with object monitor 100 as described herein), but may also have other regular charms (e.g. conventional non-functional charms). It should be noted that the system of the present invention is not limited to the use of bracelets, but rather it is contemplated that smart charm 30 of the present invention may be attached to any user wearable accessory or item of clothing.

Figure 2:
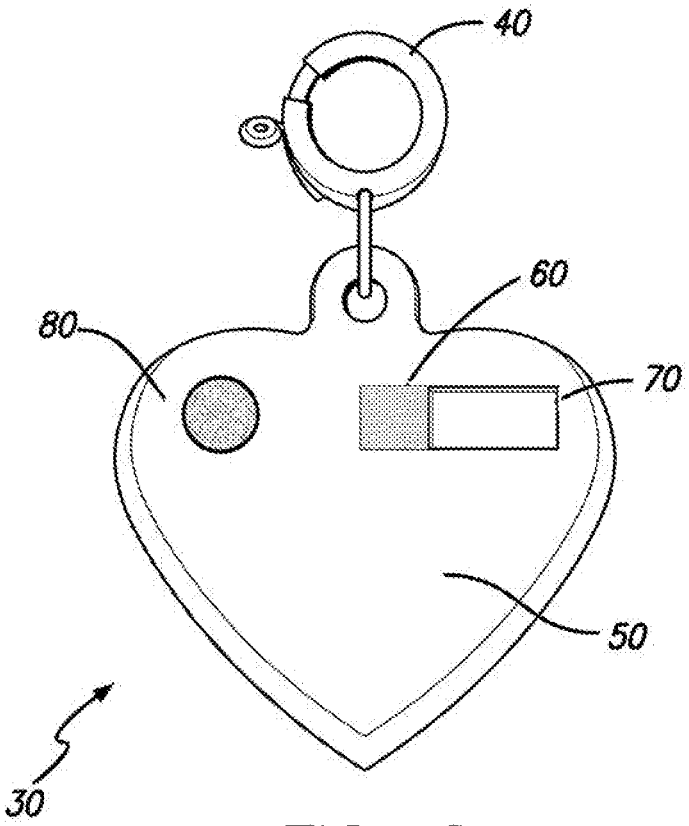
FIG. 2 is a rear perspective view of a smart charm.

Referring to FIG. 2 in a preferred embodiment of the present invention smart charm 30 will have a housing 50 that has a user-accessible power switch 60 for controlling the active status of smart charm 30 (i.e. an off and on switch). Power switch 60 may be a mechanical slide switch, and is preferably unobtrusive being contained within a recess 70 such that power switch 60 is flush with the surface of housing 50 of smart charm 30. Depending upon the size and configuration of smart charm 30 a user may need a small object like the tip of a pen or paper clip to move power switch 60. However, providing a grooved or textured outward surface of power switch 60 may be sufficient for a user finger tip to have enough friction to slide power switch 60. If more frequent and convenient control is desired, then power switch 60 may be configured such that it protrudes slightly above surface of housing 50 so that a finger may more easily be able to make the sliding movement.

It is further contemplated in a preferred embodiment that power switch 60 may be water resistant, and may have multiple click stops for activating possible different settings of smart charm 30. For example smart charm 30 may be used to set multiple sensitivity level settings for the system. An example of this may be a "distance snooze" setting where the system requires a greater separation distance before an alert sequence would be commenced. Power switch 60 may, for example, have four click stops for off, low, medium, and high/distance snooze settings.

Note that power switch 60 may take forms other than a mechanical sliding switch, such as for example a push button switch, a dial switch, or any other switch mechanism that may be appropriate or desirable for the particular form of a smart charm 30.

For example, the charm may be activated or deactivated based on the opened or closed status of an accessory attachment means: When an accessory attachment means is in a detached/open position the power to the smart charm may be switched off, and when it is in an attached/closed position the power to the smart charm may be turned on.

This may, for example, be implemented in an embodiment where an accessory attachment means comprises a small channel (roughly 5 mm in diameter) through the middle of a smart charm, such as when the smart charm has the general shape and form of a bead with a hinged clam shell housing: Such a smart charm is attached to an accessory chain or string by positioning the accessory chain or string between the opposing clam shell halves and then closing the clam shell housing over the chain or string such that when closed the chain or string passes through the small channel in the smart charm housing. In such an embodiment the smart charm would be powered off when the clam shell housing was in the open/detached position, and would be powered on when the clam shell housing was in the closed/attached position.

Smart charm 30 may have one or more sensory alert mechanisms to notify a user that an alarm has been triggered. For example smart charm 30 may have a sensory alert mechanism that is a light source 80. Light source 80 may be one or more light emitting diodes (LEDs). For example there may be three LEDs positioned along around an outer edge of a substantially circular smart charm 30 at the ten o'clock, noon, and two o'clock positions. Light source 80 may be illuminated to indicate a change in smart charm 30 status (e.g. from off to on), or when an alert sequence is triggered due to an alert sequence threshold not being satisfied. Light source 80 may emit light in a steady continuous light, or emit intermittent flashes. Light source indicator 80 may also emit light as flashes at a particular frequency or pattern to communicate a message regarding a particular status of smart charm 30 or the system.

As shown in FIG. 1 and FIG. 3 smart charm 30 has an accessory attachment means 40 for attaching smart charm 30 to an accessory such as a charm bracelet 10, necklace chain 90, or other wearable accessory. Accessory attachment means 40 may be a type of clasp, such as those jewelry clasps that are well known in the art including, for example, spring ring clasps, lobster clasps, toggle clasps, hook clasps, and box clasps. In the preferred embodiment shown in FIG. 2 accessory attachment means 40 is a spring ring clasp such that smart charm 30 may be removably attached to an object such as charm bracelet 10 or necklace chain 90.

An accessory attachment means is not limited in structure to a jewelry clasp, but can include any form, structure, or mechanism associated with the smart charm housing that functions to attach a smart charm to an accessory, clothing item, or the user. For example a channel in the housing of a smart charm through which the string or chain of a necklace or bracelet may be threaded may be an accessory attachment means. A pin mechanism attached to the housing of a smart charm that may be used to attach the smart charm to an item of user clothing, or to the user as an earring, may be a form of accessory attachment means. A clip attached to the housing of a smart charm which may be used to attach the smart charm to a user's hair or clothing may be an accessory attachment means.

Figure 7:
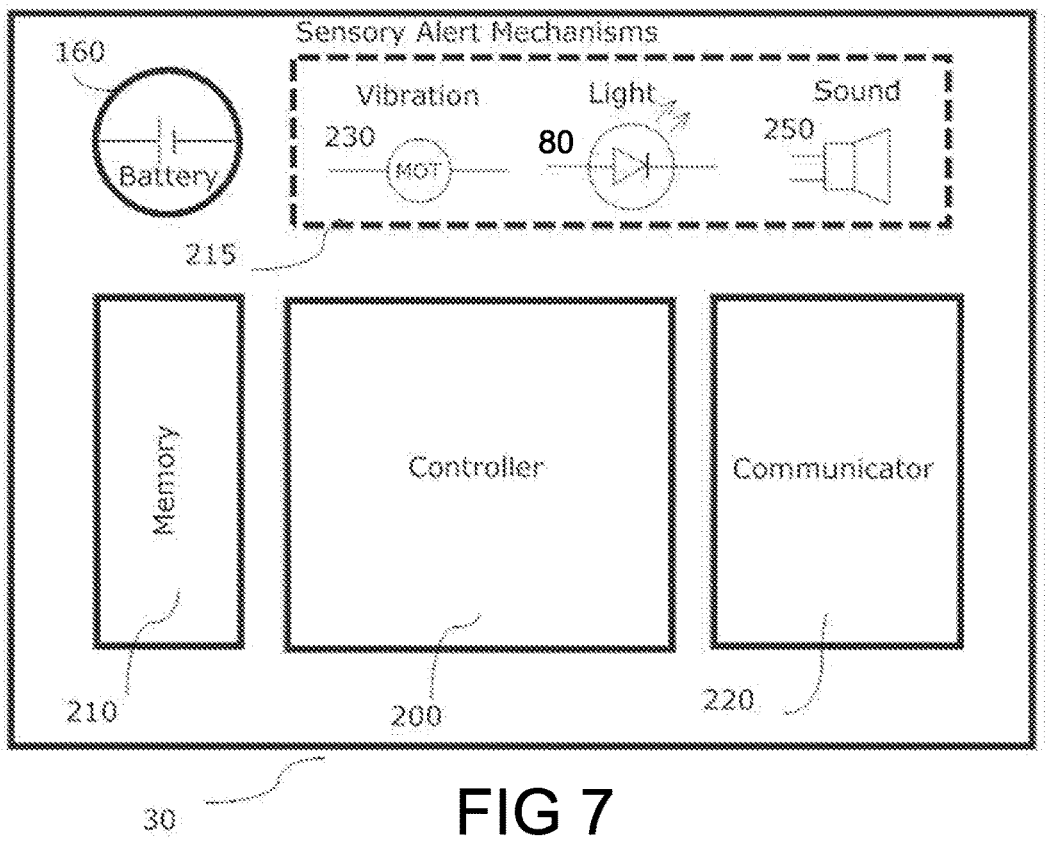
FIG. 7 is a functional block diagram of smart charm working components.

Housing 50 of smart charm 30 forms both the outward appearance of smart charm 30 and also serves the function of containing within smart charm 30 the working components of smart charm 30, as shown in FIG. 7. Housing 50 may be made of any suitable material, or combination of materials, including for example plastics or metals as are deemed appropriate or desirable for the intended environment of smart charm 30 when in use. If made of metal the housing may have an exterior antenna or embedded antenna.

Housing 50 may have an ornamental shape (e.g. a heart, cross, figurine etc. . . . ) and/or ornamental designs, words, names, monograms, crests, logos etc. . . . on its outer surfaces as is the case with customary charms used in association with items such as bracelets and necklaces, such as for example those charm forms sold by Pandora Jewelry or Brighton®.

Housing 50 preferably has a means to facilitate access to the interior of smart charm 30 for such purposes as replacing a battery or other components. The means to facilitate access to the interior of smart charm 30 may include, for example, housing 50 having a clam shell configuration with two halves that are secured together by one or more screws. Removing the one or more screws allows the two halves of housing 50 (which may or may not be hinged together at an edge of housing 50) to be manually separated permitting access to the interior of smart charm 30. Housing 50 of smart charm 30 may also be water resistant to prevent moisture from intruding into the interior of smart charm 30 and possibly interfering with the function of, or damaging, interior components. So for example a smart charm having clam shell housing may have a plastic or rubber grommet used to form a watertight seal between the two halves of the housing when they are in the closed position.

Referring to FIG. 7 the functional components of a preferred embodiment of smart charm 30 that are at least partially contained within smart charm housing 50 comprise a battery 160, controller 200, memory 210, sensory alert mechanisms 215 (such as an audio signal generator 250, light source 80, and/or vibration generator 230), and a communicator 220. Smart charm 30 may have such components packaged in layers with the housing, circuit board, battery, speaker etc. . . . being round and stacked against one another.

Smart charm battery 160 which provides the power for the operation of the smart charm may be a round 3 volt button cell battery such as a lithium/manganese dioxide CR1620 (75 mAh) or CR1632 (140 mAh).

Smart charm 30 will contain operating instructions (e.g. computer programming instructions), some of which may be stored in smart charm memory 210, that are implemented by smart charm 30 during operation of the system of the present invention. Operating instructions may be processed by smart charm controller 200, which may be a conventional single chip microcontroller such as, for example, a Harvard architecture Intel MCS-51 (commonly referred to as 8051). The operating instructions for smart charm 30 may be present in smart charm 30 as firmware, software, and/or hardware (e.g. logic circuits programmed by a hardware description language). It is contemplated that the operating instructions for smart charm 30 may be implemented using any number of well known programming languages and methodologies including, for example, assembly language, C language, and/or verilog HDL. Operating instructions may be contained in whole or in part in smart charm memory 210, which is contemplated in a preferred embodiment to be flash memory. Communicator 220 of smart charm 30 is contemplated to include a radio frequency transceiver operating in the 2.4 GHz ISM band, and a radio frequency antenna. Some or all of the aforementioned smart charm 30 components may be implemented as a system on a chip.

Sensory alert mechanisms 215 for the smart charm component are contemplated to include an auditory signal generator (e.g. a speaker device) 250, mechanical vibration generator 230, and/or a light source 240. Such sensory alert mechanisms, alone or in combination, will be activated upon an alert sequence being initiated and carried out by the system. In a preferred embodiment the auditory signal generator 250 may be piezoelectric speaker, and may use a digital to analog converter (DAC) with a differential+/−3 volts to drive the speaker. Smart charm audio signal generator 250 should be able to produce sound at a level of at least 75 decibels. Smart charm 30 light source 80 would preferably be one or more light emitting diodes (LEDs). Mechanical vibration generator 230 would preferably be a coin shaped (or "pancake") vibration motor.

The Object Monitor

Figure 8:
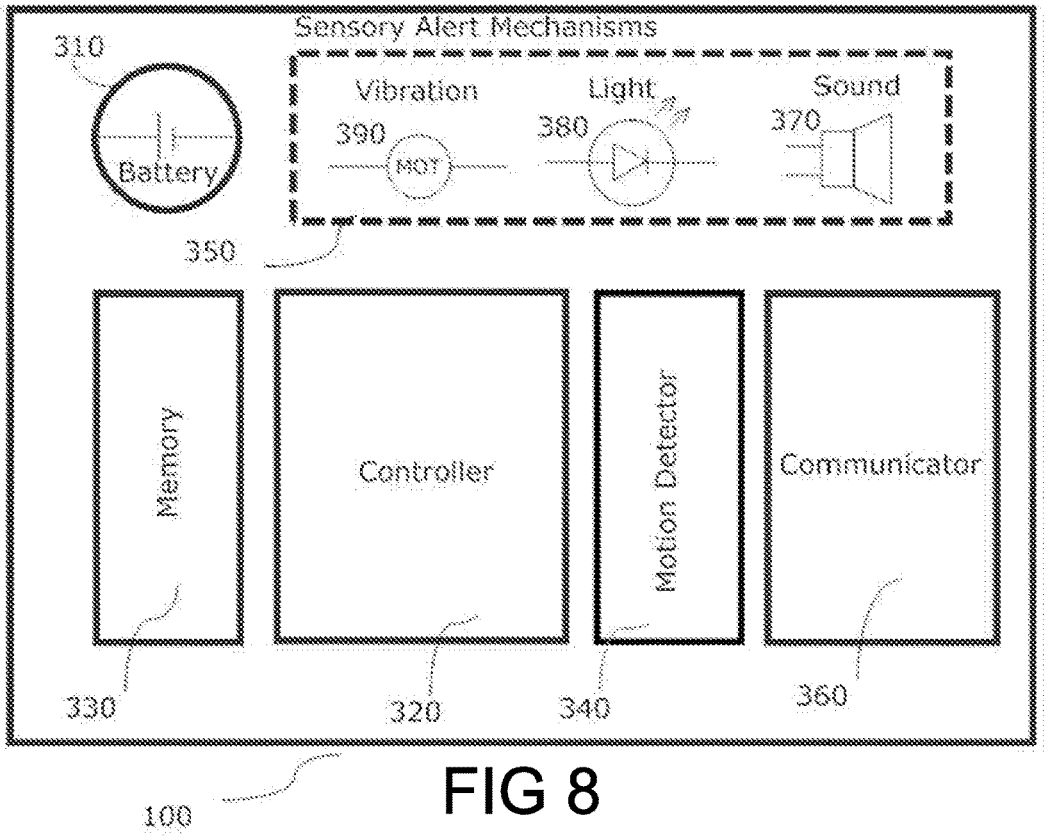
FIG. 8 is a functional block diagram of object monitor working components.

As shown in FIG. 4 object monitor 100 is attached to, inserted in, or combined with a mobile object 130, such as a wallet or purse. Referring to FIG. 8 the functional components of object monitor 100 are illustrated. The functional components of a preferred embodiment of object monitor include a housing containing a power source 310, controller 320, memory 330, motion detector 340, sensory alert mechanisms 350 (audio signal generator 370, light source 380, vibration generator 390), and a communicator 360.

In a preferred embodiment the housing of object monitor 100 is in the form of a standard bank card (e.g. 8.5 w×5.4 h×0.35 d cm), such that object monitor 100 may fit in a credit card slot of a wallet or purse. The housing of object monitor 100 may be a hardened plastic or metal. If object monitor 100 housing (or the housing of smart charm 30) is metal then any radio frequency antenna used should preferably be located external to the housing. Housing for object monitor 100 should be reasonably water resistant with tight fitting closures.

Object monitor power source 310 may be one or more round 3 volt button cell batteries such as a lithium/manganese dioxide CR1620 (75 mAh) or CR1632 (140 mAh). Housing for object monitor 100 may have a side slot, or a removable panel, through which batteries can be replaced.

Object monitor 100 will contain operating instructions (e.g. computer programming instructions), some of which may be stored in object monitor memory 330, that are implemented by object monitor 100 during operation of the system of the present invention. Operating instructions may be processed by object monitor controller 320, which may be a conventional single chip microcontroller such as, for example, a Harvard architecture Intel MCS-51 (commonly referred to as 8051). The operating instructions for object monitor 100 may be present in object monitor 100 as firmware, software, and/or hardware (e.g. logic circuits programmed by a hardware description language).

It is contemplated that the operating instructions for object monitor 100 may be implemented using any number of well known programming languages and methodologies including, for example, assembly language, C language, and/or verilog HDL. Operating instructions may be contained in whole or in part in object monitor memory 330, which is contemplated in a preferred embodiment to be flash memory. Communicator 360 of object monitor 100 is contemplated to include a radio frequency transceiver operating in the 2.4 GHz ISM band, and a radio frequency antenna. Some or all of the aforementioned object monitor 100 components may be implemented as a system on a chip.

In a preferred embodiment of the system of the present invention object monitor 100 has a sensory alert mechanism comprising at least an auditory signal generator 370, preferably in the form of a piezoelectric speaker that will operate at a level of at least 90 dB, which is noticeably louder than the audio alarm emitted by the smart charm of the system.

Object monitor 100 may also have one or more light sources 380 that emit light depending upon the status of object monitor 100 or the system of the present invention.

The sensory alert mechanisms of object monitor 100 are intended to alert a user of the system who is separated from the object monitor 100 (e.g. because of theft). Accordingly, sensory alert mechanisms involving light emission or mechanical vibrations may be omitted from object monitor 100, as these may not be perceptible to user who is separated from object monitor 100 which may be concealed in an object such as a wallet or purse. Omitting such sensory alert mechanisms from object monitor 100 may result in cost and energy savings.

However, in other embodiments of the object monitor light sources and mechanical vibration may be included as features. Should a light source 380 be included, then it is contemplated to be one or more light emitting diodes. Light source 380 may be illuminated to indicate a change in object monitor status (e.g. from off to on), or when an alarm is triggered due to a separation distance threshold being exceeded. Light source 380 may emit light in a steady continuous fashion, or as intermittent flashes. Light source 380 may also emit light as flashes of a particular frequency or pattern to communicate a particular message regarding the status of the object monitor or the system. Similarly, the object monitor may also have a vibration motor 390 for producing a mechanical vibration.

In a preferred embodiment for an object monitor there is also a motion detector 340. The addition of motion detector 340 to object monitor 100 can improve overall performance of the system. Particularly, motion detector 340 generates a motion state signal to indicate the motion state for object monitor 100 (where motion may be an indication of theft). If object monitor controller 320 detects that object monitor 100 is in motion it lowers the transmission power level of communicator 360. This effectively reduces the separation distance at which an alert sequence for the system will be triggered. If object monitor controller 320 determines that object monitor 100 is in a state of rest then object monitor controller 320 raises or maintains a maximum transmission power level for communicator 360 to effectively increase the separation distance at which an alert sequence is triggered. This has the benefit to the system of reducing the number of false alert sequences that may be triggered when object monitor 100 is at rest. Motion detector 340 of object monitor 100 may be a 3 volt accelerometer (single, dual or triple axis), a rolling ball motion detector, or any other suitable motion detecting device as is known to those of ordinary skill in the art.

Figure 5:
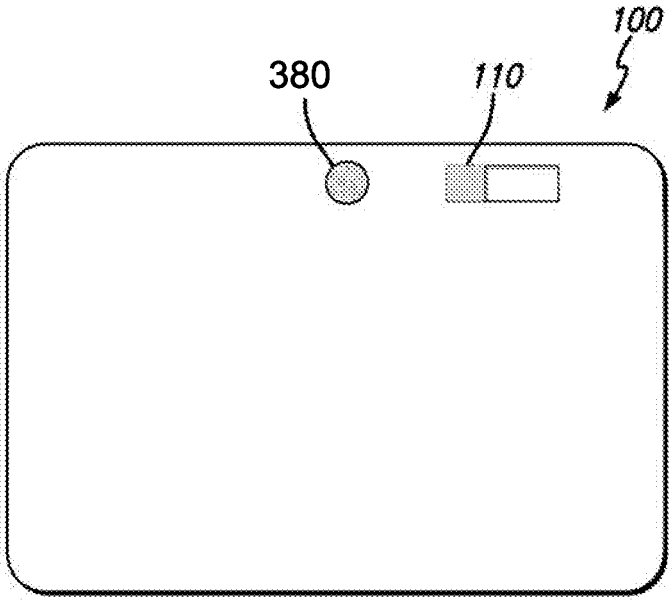
FIG. 5 is a front view of an object monitor.

Referring to FIG. 5, it is contemplated that in a preferred embodiment object monitor 100 would have a power switch 110 to change its active status (e.g. from off to on). In the preferred embodiment where object monitor 100 is in the shape of a standard banking card, power switch 110 may be located proximate to an upper long edge of object monitor 100 such that a user would not have to remove object monitor 100 from a wallet 130 when utilizing power switch 110. Power switch 110 may be a mechanical slide switch, and is preferably unobtrusive being contained within a recess such that power switch 110 is flush with the surface of the housing of object monitor 100. Depending upon the size and configuration of power switch 110 a user may need a small object like the tip of a pen or paper clip to move power switch 110. However, providing a grooved or textured outward surface of power switch 110 may be sufficient for a user finger tip to have enough friction to slide power switch 110. If more frequent and convenient control is desired, then power switch 110 may be configured such that it protrudes slightly above surface of the housing for object monitor 100 so that a finger may more easily be able to make the sliding movement.

It is contemplated in a preferred embodiment that power switch 110 would be water resistant, and may have multiple click stops for activating different contemplated settings of the system of the present invention. For example the system may have multiple sensitivity level settings for adjusting the separation distance with smart charm 30 before an alert sequence is triggered. Power switch 110 may take forms other than a mechanical sliding switch. Power switch 110 may, for example, be comprised of a push button switch, a dial switch, or any other switch mechanism that may be appropriate or desirable for the particular form of object monitor 100.

Smart Charm System Operation

The system of the present invention contemplates the use of a smart charm 30 paired with a corresponding object monitor 100. Each smart charm/object monitor pair is contemplated to have a unique identification code that facilitates a communication link between the smart charm and object monitor of the pair.

In the operation of the system of the present invention a user wanting to be alerted upon being separated from an object attaches an object monitor 100 to such object. For example, referring to FIG. 4 in the case where the object is a wallet 130, and the object monitor is of the shape and size of a standard banking card (i.e. a "smart card") the user places object monitor 100 in wallet 130, perhaps in a slot designed to accommodate a credit card.

The user activates object monitor 100 by sliding power switch 110 to an on position. Upon doing so object monitor 100 may give a sensory indication to the user that object monitor 100 is now active. Such a sensory indication may, depending upon the particular features object monitor 100 has include an audible signal produced by a speaker, a visual indication from a light source, and/or a mechanical vibration produced by a vibration motor.

The user activates smart charm 30 by sliding power switch 60 to an on position. Upon doing so smart charm 30 may give a sensory indication to the user that smart charm 30 is now active. Such a sensory indication may, depending upon the particular features smart charm 30 has include an audible signal produced by an audio signal generator 250, a visual indication from a light source 240, and/or a mechanical vibration from a vibration motor 230.

In a preferred embodiment of the system of the present invention smart charm 30 and object monitor 100 enter into a paired communication once both are in an active state, such as may be accomplished, for example, with a conventional Bluetooth radio frequency pairing as is known to those of ordinary skill in the art. The unique identification code associated with the smart charm/object monitor pair may be used as a passkey to ensure that smart charm 30 may only be paired with its corresponding object monitor 100.

Figure 9:
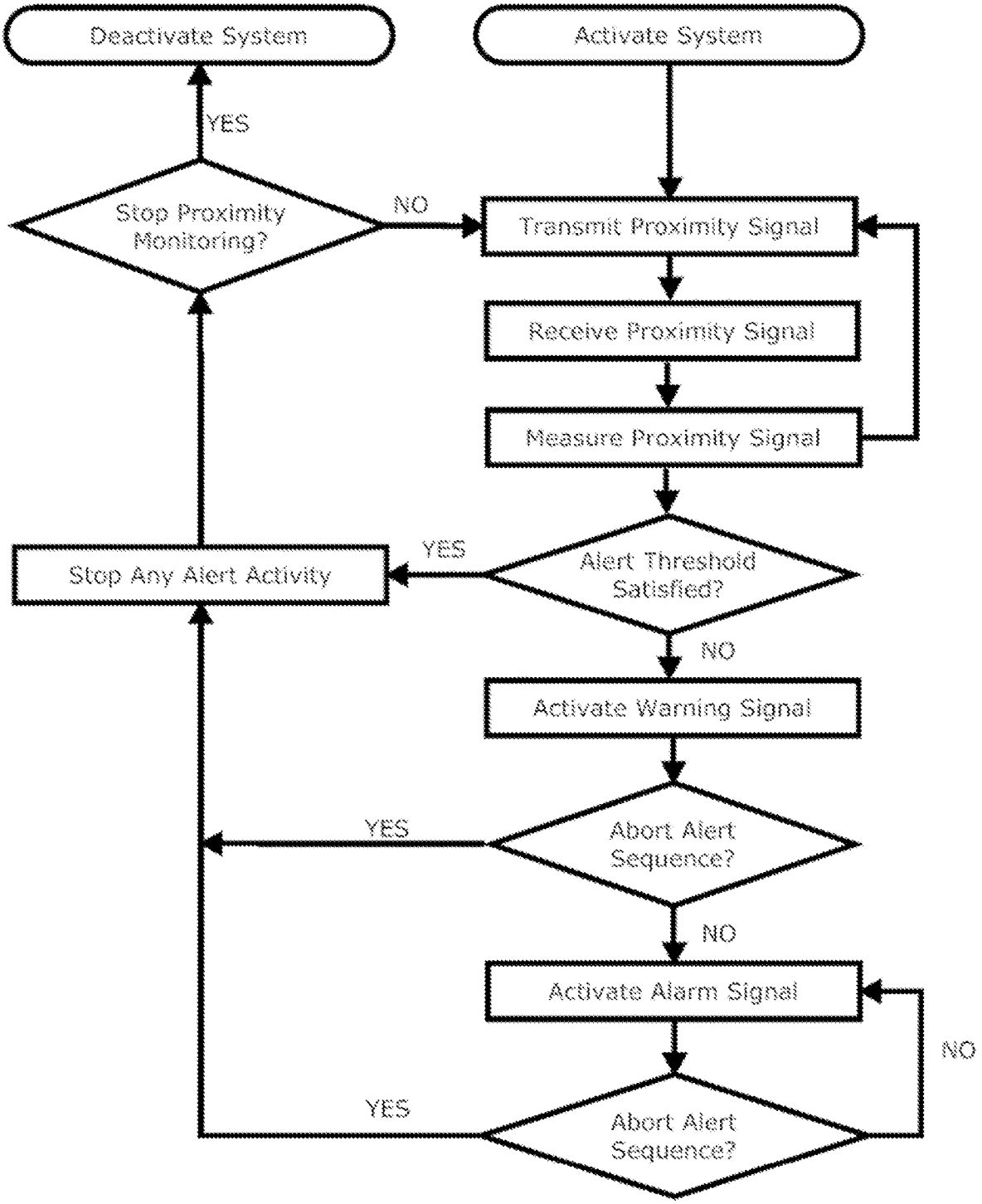
FIG. 9 is a flowchart of the general operation of the system of the present invention.

Referring to FIG. 9, in a preferred embodiment a smart charm 30 acts as a receiver for radio frequency proximity signal pulses 150 that are transmitted by object monitor 100 paired with smart charm 30. Smart charm 30 contains operating instructions that include instructions for measurement of a received proximity signal 150 transmitted by the paired object monitor 100, the measurement being an indication of the separation distance between smart charm 30 and object monitor 100. The smart charm 30 also contains operating instructions to determine whether or not to commence an alert sequence based on the measurement made of the received proximity signal 150.

In one embodiment the received signal strength of proximity signal 150 is measured by the smart charm 30 and the path loss determined (based on the known strength of the transmitted proximity signal 150). The path loss is then used to determine whether to activate an alert sequence. Such a technique may, for example, be implemented in the present system in accordance with the known Bluetooth Generic Attribute Proximity Profile.

Another measurement technique is the transmittal by object monitor 100 of a known number of proximity signal pulses 150 during a set time period. For example, the system of the present invention may be programmed such that object monitor 100 communicator transmits one hundred proximity pulses 150 during a time period of one minute. The number of transmitted proximity pulses 150 received by smart charm 30 from the paired object monitor 100 during the one minute period is measured. The measurement of received proximity pulses 150 is used to determine whether to activate an alert sequence.

In all embodiments the measurement of received proximity signal 150 is evaluated to determine whether a threshold alert criterion is satisfied. For example, the threshold alert criterion may be set to require that the number of received proximity signal pulses counted during the set period of time be a certain minimum number, or require that the determined path loss not exceed a certain amount. If the threshold alert criterion is not satisfied then the system will commence an alert sequence. It is contemplated that whether or not the system commences an alert sequence that proximity signal pulses will continue to be transmitted by the object monitor and measured, such that if after an alert sequence is commenced the measurement satisfies the threshold alert criterion, then the alert may be cancelled.

To help prevent false alert sequences being triggered on account of environmental interferences and/or minor object monitor movements during measurement of received proximity signals 150 a hysteresis factor may be used when programming the threshold alert criterion for an alert sequence to be triggered. The adverse impact of environment influences may also be reduced by utilizing such techniques as spread spectrum for the proximity signals, adjusting the number of proximity pulses, proximity period, or delays between set time periods for transmitting proximity pulses.

In a preferred embodiment an alert sequence commences with a sensory alert mechanism warning signal to the user, such as for example the smart charm vibrating and/or lights flashing. The warning signal may give the user an opportunity to take action before an alarm is sounded, such as for example hitting a "silence" or "snooze" button on the smart charm. The warning signal period may be fixed or adjustable by a user, and in a preferred embodiment is contemplated to be in the range of one-quarter to six seconds, although other ranges are within the scope of the invention.

After the warning signal period the smart charm may adjust the sensory alerts on the smart charm to increase user awareness. This may include increasing the intensity of any sensory alert mechanisms already triggered as a warning signal (e.g. make the audio signal louder), or by increasing the number of sensory alert mechanisms (e.g. adding an audio alert if the warning signal consisted of only a mechanical vibration alert). The audio alert of the smart charm should preferably be at least 75 dB.

It is also contemplated that a smart charm may adjust or increase the intensity of sensory alert mechanisms based upon environmental conditions. For example, smart charm may incorporate a light sensor to detect ambient levels of light, and add a visual alert (or adjust the intensity) based on the detected level of ambient light. Similarly, smart charm may have an acoustic sensor to determine the level of ambient sound, and adjust the intensity of the audio alert accordingly.

Figure 6:
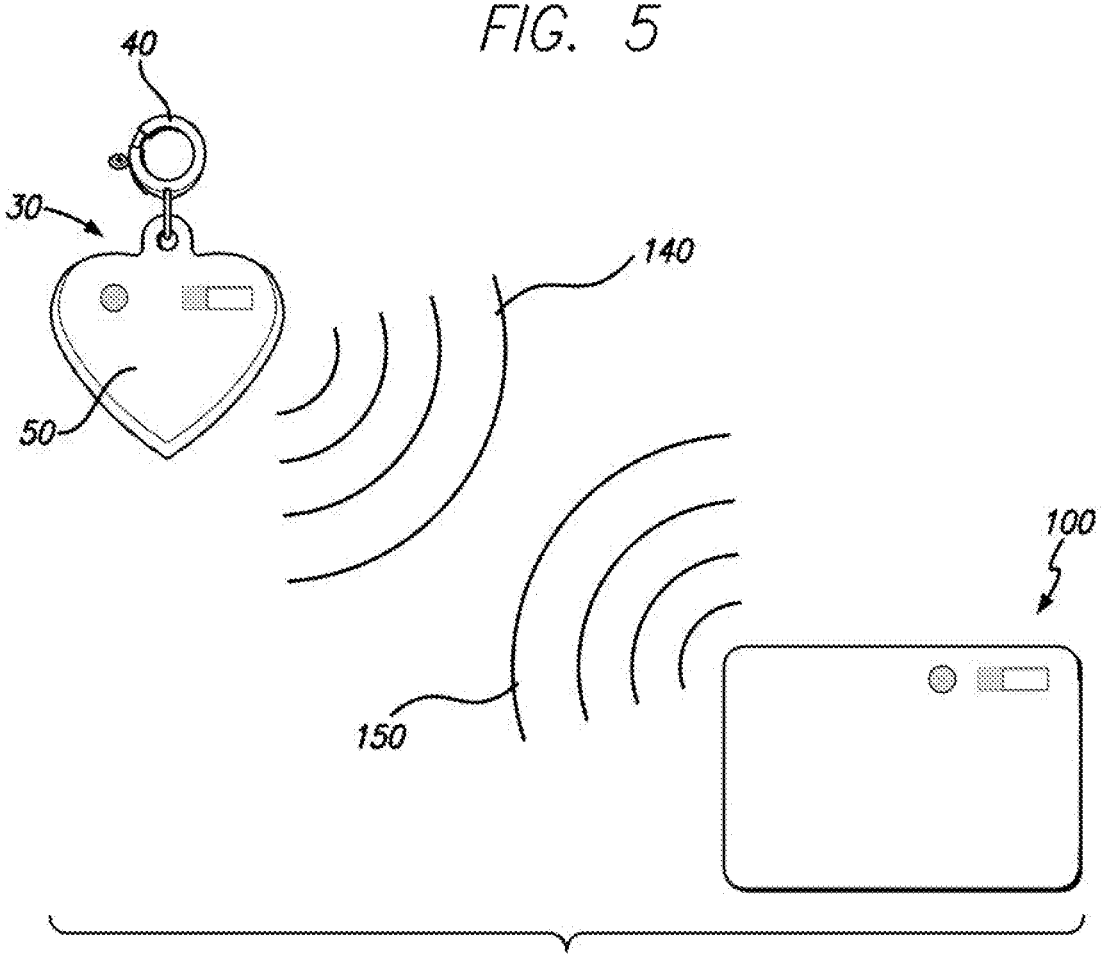
FIG. 6 is an illustration of a smart charm in communication with an object monitor.

As shown in FIG. 6, after the warning period smart charm 30 also transmits alarm signal 140 to be received by the object monitor 100. When alarm signal 140 is received by object monitor 100 the sensory alert mechanisms that constitute the alarm features of object monitor 100 are activated. Such sensory alert mechanisms are contemplated to include at least an audio alert (preferably louder than the smart charm) emitted by auditory signal generator 370.

It is also contemplated that in some embodiments object monitor 100 may have alarm features that include producing light and vibration. It is also contemplated that object monitor 100 may adjust or increase the intensity of sensory alerts based upon environmental conditions. For example, an object monitor may incorporate a light sensor to detect ambient levels of light, and add a visual alert (or adjust the intensity) based on the detected level of ambient light. Similarly, an object monitor may have an acoustic sensor to determine the level of ambient sound, and adjust the intensity of the audio alert accordingly.

Once object monitor 100 receives alarm signal 140 the sensory alert mechanisms will be activated and continue to be active until the alert sequence is cancelled. In a preferred embodiment the user may cancel an alert sequence by moving power switch 60, or pushing a separate button, to enter the system into a "snooze" or "silence" mode. Doing so causes smart charm 30 to transmit a maximum power cancel signal to be received by object monitor 100 to stop the sensory alert mechanisms of object monitor 100. In an alternative embodiment a user moving power switch 60, or pushing a separate button, on smart charm 30 may cause both smart charm 30 and object monitor 100 to turn off. The alert sequence may also be cancelled if the measurement for the proximity pulses 150 received by the smart charm rise again satisfy the threshold alert criterion. In some embodiments the alarm may also simply stop after a certain period of time has elapsed.

In addition to other techniques mentioned herein for reducing false alerts, in a preferred embodiment object monitor 100 uses a motion detector to regulate the power of the proximity pulses from object monitor 100. Specifically, as long as object monitor 100 is at rest (no motion detected) the object monitor will transmit proximity signal pulses 150 at maximum power. This helps to increase the probability that proximity signal pulses 150 will be received and measured by smart charm 30 in the event that there are environmental interferences (e.g. objects or persons coming in between the smart charm and object monitor). Transmitting at maximum power also effectively extends the distance between the smart charm and object monitor before an alert sequence will be triggered.

However, when motion of object monitor 100 is detected which could be an indication that the object with the object monitor is being stolen or otherwise moved without authorization then object monitor 100 reduces the power of transmitted proximity pulses 150. Reducing the power of transmitted proximity signal pulses 150 reduces the probability that the proximity signal pulses 150 will be received and measured by smart charm 30, and thus increases the chances that an alert sequence will be triggered, unless the smart charm and object monitor are in close proximity such as the object with the transmitting object monitor being moved by, or carried on, the person wearing the smart charm. It is further contemplated that a user of the present invention may have the option of disabling the motion detection feature with a motion detector actuator, either directly through a button or switch setting on the object monitor, or remotely from the smart charm (again through the use of a switch setting or button).

It is further contemplated that smart charm may also have a distance snooze feature that permits a user to extend the effective separation distance between the smart charm and object monitor before an alert sequence is triggered by pressing a button, or setting a switch, which causes the threshold alert criterion to be changed.

In addition to creating a sensory alert when an alert sequence is triggered, it is also contemplated that the smart charm 30 and object monitor 100 would activate a sensory alert mechanism in response to a low battery condition. The sensory alert may for example include a periodic audio alert (e.g. a beep), a distinct pattern of light flashes, etc. . . . The object monitor 100 may also transmit a signal to smart charm 30 communicating the low battery status of the object monitor 100 so that a low battery sensory alert may be triggered on smart charm 30 that is more perceptible to a user than just a low battery alert on the object monitor 100 which may be contained within an object 130 such as a wallet.

With respect to sensory alerts the smart charm 30 and/or object monitor 100 could have any different number of alert types, such as for example, (1) a high, low tone at 1 min interval-low battery; (2) high, low one time—device entering inactive mode; (3) low, high tone—device entering active mode4 (4) vibration and low staccato tone—pre-alert warning; (5) theft alert: repeating high tone, flashing lights and periodic vibration, (6) different audio frequencies—frequencies selected will maximize the sound level, (7) alert duration—each device will have a timeout for slowing down and/or stopping an alert; (8) a pattern alert—wherever possible, the devices will utilize a power-saving sound, vibration and light emission pattern.

A smart charm 30 or object monitor 100 may also have several power modes depending on the activity it is performing or being asked to perform. For example: (1) high power—whenever device is transmitting a proximity signal (2) medium power—when device is receiving a transmission (3) low power—normal processing not involving transmission or receiving, (4) immediate sleep mode—for no processing or, (5) deep sleep mode—paired devices enter deep sleep mode when there is no activity (at nighttime or devices at rest).

In a preferred embodiment of the present invention it is contemplated that serial numbers may be etched into each smart charm 30 and object monitor 100 or otherwise associated with smart charm/object monitor pair (e.g. just printed on/labels affixed to a registration card). For security reasons the visible serial numbers may be associated with, but not the same as, the unique identification codes programmed into smart charm/object monitor pairs that are used for pairing during operation. A proprietary and confidential software program may be used to maintain a correlation between a serial number and unique identification codes if for some reason there was a need to repair or replace a lost or stolen smart charm or object monitor.

It is also contemplated that the system of the present invention may utilize as a power source rechargeable batteries in the smart charm and/or object monitor. The rechargeable batteries may be removable. However, it is also contemplated that the system of the present invention may use non-removable batteries that may be recharged by plugging the smart charm and/or object monitor into a charging device. The charging device may be of the wireless or inductive type of charging.

The invention claimed is:

1. An anti-theft proximity alert system comprising:

a wearable smart charm and an object monitor;

said wearable smart charm having an ornamental charm housing;

wherein said ornamental charm housing contains a snooze switch, a sensory alert, an alarm controller, an alarm communicator capable of receiving a radio frequency proximity signal transmitted from said object monitor, at least one operating instruction to determine a measure of said radio frequency proximity signal, at least one alarm operating instruction to determine if said measure satisfies a threshold alert criterion, and at least one distance snooze operating instruction to adjust said threshold alert criterion based upon a setting of said snooze switch.

2. An anti-theft proximity alert system comprising:

a wearable smart charm and an object monitor;

said wearable smart charm having an ornamental charm housing;

wherein said ornamental charm housing contains a snooze switch, a sensory alert, an alarm controller, an alarm communicator capable of receiving a radio frequency proximity signal transmitted from said object monitor, at least one operating instruction to determine a measure of said radio frequency proximity signal, at least one alarm operating instruction to determine if said measure satisfies a threshold alert criterion, and at least one distance snooze operating instruction to adjust the power of said radio frequency proximity signal based upon a setting of said snooze switch.

* * * * *